US010178470B2

(12) United States Patent
Watanabe et al.

(10) Patent No.: US 10,178,470 B2
(45) **Date of Patent: *Jan. 8, 2019**

(54) ELECTRONIC MACHINE, AND AUTOMOBILE AND ACCOMMODATION UNIT PROVIDED WITH THE SAME

(71) Applicants: PIONEER CORPORATION, Kanagawa (JP); TOHOKU PIONEER CORPORATION, Tendo, Yamagata (JP)

(72) Inventors: Hiroaki Watanabe, Tendo (JP); Nobuyuki Sato, Tendo (JP); Takeru Miki, Tendo (JP); Toshiya Kosaka, Tendo (JP); Eitaro Unno, Tendo (JP); Takahiro Kudo, Tendo (JP); Yoshihiko Takeda, Tendo (JP)

(73) Assignees: PIONEER CORPORATION, Kawasaki-shi, Kanagawa (JP); TOHOKU PIONEER CORPORATION, Tendo-shi, Yamagata (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/437,791

(22) Filed: Feb. 21, 2017

(65) Prior Publication Data

US 2017/0162181 A1 Jun. 8, 2017

Related U.S. Application Data

(63) Continuation of application No. 14/406,036, filed as application No. PCT/JP2012/064596 on Jun. 6, 2012, now Pat. No. 9,615,166.

(51) Int. Cl.

| | |
|---|---|
| ***H04R 1/32*** | (2006.01) |
| ***H04R 1/02*** | (2006.01) |
| ***G10K 11/00*** | (2006.01) |

(52) U.S. Cl.

CPC ..... *H04R 1/323* (2013.01); *G10K 11/004* (2013.01); *H04R 1/02* (2013.01); *H04R 1/025* (2013.01);

(Continued)

(58) Field of Classification Search

CPC . H04R 1/32; H04R 1/323; H04R 5/02; H04R 5/023; H04R 2201/021; H04R 2201/025; H04R 2499/13

See application file for complete search history.

(56) References Cited

U.S. PATENT DOCUMENTS

| | | | |
|---|---|---|---|
| 3,719,250 | A | 3/1973 | Maekawa |
| 4,365,114 | A | 12/1982 | Soma |

(Continued)

FOREIGN PATENT DOCUMENTS

| | | | |
|---|---|---|---|
| JP | 56-6188 | A | 1/1981 |
| JP | 61-151496 | U | 9/1986 |

(Continued)

OTHER PUBLICATIONS

Communication dated Jan. 23, 2018 from the Japanese Patent Office in counterpart Japanese application No. 2017-021358.

*Primary Examiner* — Joshua Kaufman
(74) *Attorney, Agent, or Firm* — Sughrue Mion, PLLC

(57) ABSTRACT

Provided is an electronic machine including a speaker unit; a housing; and a rotating device. The rotating device rotates the speaker unit with respect to the housing, wherein the speaker unit is provided with an opening portion and a member which is supported by the housing and extends substantially in parallel to a rotational axis of the speaker unit is adapted to passing through the opening portion.

19 Claims, 8 Drawing Sheets

(52) U.S. Cl.
CPC ..... *H04R 1/026* (2013.01); *H04R 2201/021* (2013.01); *H04R 2201/025* (2013.01); *H04R 2499/13* (2013.01)

(56) References Cited

U.S. PATENT DOCUMENTS 4,441,577 A 4/1984 Kurihara
4,553,630 A 11/1985 Ando
4,597,470 A 7/1986 Takagi et al.
4,630,303 A 12/1986 Tanno
4,811,406 A 3/1989 Kawachi
5,133,428 A * 7/1992 Perrson ..... B60R 11/0217 181/153
5,321,760 A 6/1994 Gray
5,859,917 A 1/1999 Silber et al.
6,347,776 B1 2/2002 Chuang
7,171,013 B2 1/2007 Kosatos et al.
8,229,155 B2 7/2012 Maurer et al.
8,259,980 B2 9/2012 Maurer et al.
8,634,586 B2 1/2014 Smith et al.
2007/0025580 A1* 2/2007 Reardon ..... H04R 1/025 381/387
2007/0090250 A1* 4/2007 O'Keene ..... F16M 11/10 248/299.1
2007/0253304 A1* 11/2007 Hsu ..... G11B 31/00 369/65
2008/0130938 A1 6/2008 Wan
2008/0199037 A1* 8/2008 Xu ..... H04R 1/345 381/387
2008/0247593 A1 10/2008 Sprinkle
2009/0046886 A1* 2/2009 Lin ..... H04R 1/323 381/395
2013/0177197 A1 7/2013 Fujisawa et al.
2013/0182883 A1 7/2013 Takeda et al.
2014/0064549 A1 3/2014 Liang et al.
2015/0086035 A1 3/2015 Shin
2015/0131842 A1 5/2015 Watanabe et al.

FOREIGN PATENT DOCUMENTS

JP 61-165244 U 10/1986
JP 06-6887 A 1/1994
JP 2001-298787 A 10/2001

* cited by examiner

ELECTRONIC MACHINE, AND AUTOMOBILE AND ACCOMMODATION UNIT PROVIDED WITH THE SAME

CROSS REFERENCE TO RELATED APPLICATIONS

This application is a Continuation Application of U.S. application Ser. No. 14/406,036 filed Jan. 22, 2015, which is a National Stage of International Application No. PCT/JP2012/064596, filed Jun. 6, 2012, the content of which is incorporated herein by reference in its entirety.

TECHNICAL FIELD

The present invention relates to an electronic machine accommodating a speaker used in a sound reproducing apparatus, and an automobile and a accommodation unit provided with the same.

BACKGROUND ART

In recent years, in sound reproduction, a so-called surround system has been employed and various methods of allowing a user to change a direction or an installation position of a speaker by hands have been employed in order to improve a feeling of presence in a two-channel stereo system.

Of these methods, a technology of allowing a user to directly change a direction of a speaker by hands has an advantage that can improve the user's visibility with respect to sound by adapting to the user's taste. As an example of a literature disclosing the relevant technology, Patent Literature 1 discloses a technology of a speaker device including a housing assembly that is installed such that a grill is protruded from a wall by a case incorporating a speaker and the grill provided at a front opening side thereof, and an attaching mechanism that attaches and fixes the speaker to a desired angle position by rotating the speaker with respect to the housing assembly, wherein the attaching mechanism can be operated at the grill side protruded from the wall. According to the configuration, the user can directly rotate a speaker unit by hands and fix the speaker unit at a desired angle. However, in the technology described in the Patent Literature 1, the operability to directly rotate the speaker unit by the user's hands has been relatively bad.

Also, for example, Patent Literature 2 discloses a technology configured to mount a speaker unit to a rotation chamber, support a rotational axis provided in the rotation chamber through a bearing provided in a fixed chamber, and drive a circular arc-shaped gear, which is provided in an outer periphery of the rotation chamber, by a motor through another circular gear.

However, in the technology described in Patent Literature 1 or Patent Literature 2, it is possible to change the angle only in a straight line direction such that the direction of the speaker becomes a vertical direction or a horizontal direction, and the direction of the speaker could not be appropriately and arbitrarily changed.

Further, for example, Patent Literature 3 discloses a technology that includes a rotation reference face forming means forming a rotation reference face, a rotation face forming means forming a rotation face capable of rotating along the rotation reference face, and a speaker mounted on the rotation face forming means such that the speaker is inclined at a predetermined angle with respect to the rotation reference face, wherein the orientation of the reference axis of the speaker can be changed by the rotation of the rotation face forming means.

However, the orientation of the reference axis of the speaker can be merely changed by the rotation of the rotation face forming means, and the direction of the speaker could not still be appropriately and arbitrarily changed.

CITATION LIST

Patent Literature

Patent Literature 1: JP 56-6188 Y
Patent Literature 2: JP 6-6887 A
Patent Literature 3: JP 2001-298787 A

SUMMARY OF INVENTION

Technical Problem

An object of the present invention is to achieve the problems. That is, an object of the present invention is to provide an electronic machine equipped with a speaker and configured to change a direction of the speaker appropriately and arbitrarily.

Solution to Problem

To achieve such an objective, an earphone according to the present invention includes at least the following configuration:

An electronic machine comprising: a speaker unit; a housing; and a rotating device, wherein, the rotating device rotates the speaker unit with respect to the housing about a direction intersecting with an axis of the housing serving as a rotational axis, wherein the rotational axis is positioned inside of the housing.

REFERENCE SIGNS LIST

Figure 1:
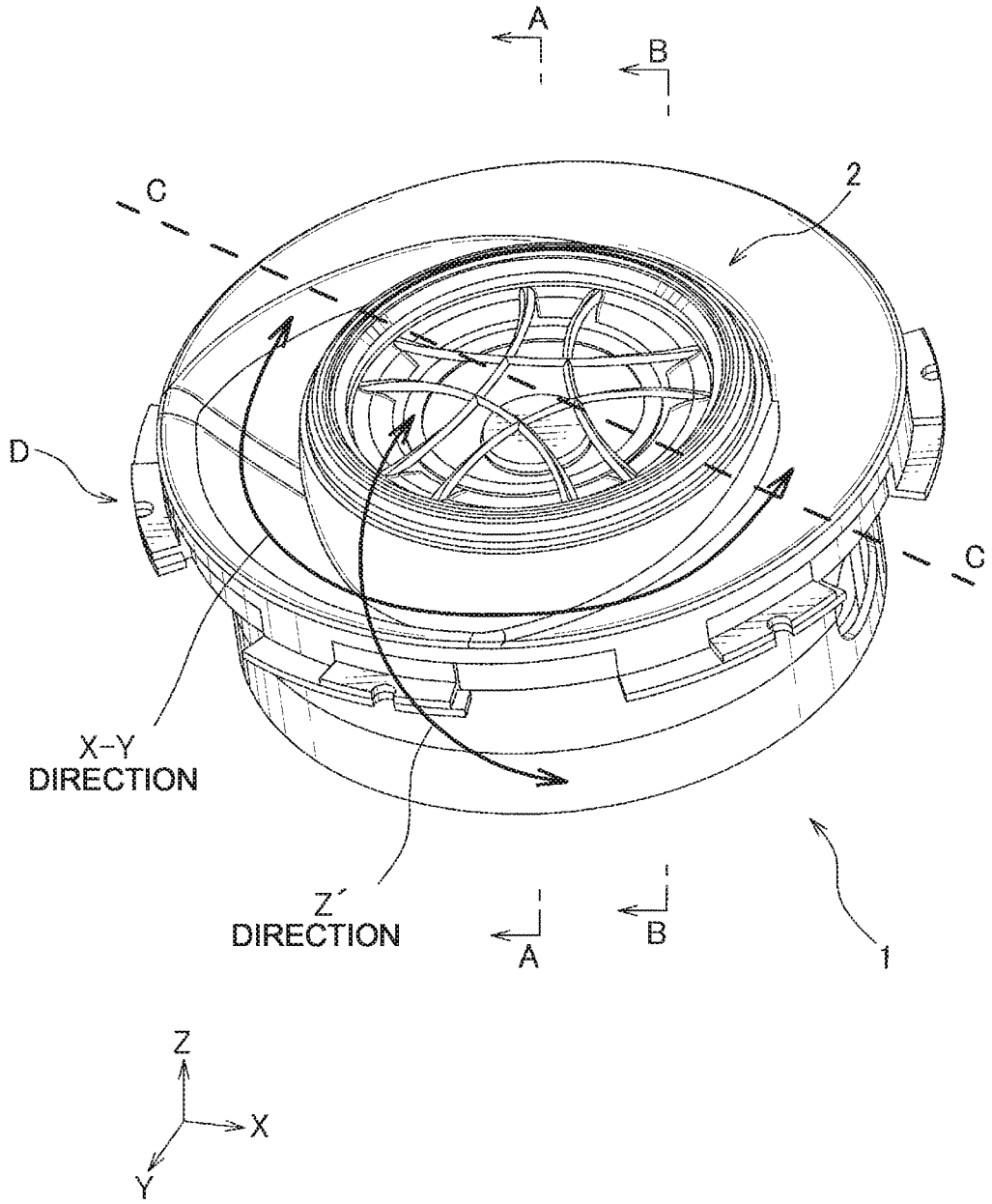
FIG. 1 is a perspective view illustrating a speaker device (electronic machine) according to an exemplary embodiment of the present invention.

1 speaker device (electronic machine)
2 speaker unit
3 first rotating device
4 first housing
5*a*, 5*b* convex portion
6 second housing
6*a* flap portion
8 second rotating device
8*a* motor
8*b* gear (rotating member)
8*c* gear (rotated member)
10 concave portion
11 rod-shaped member
13 plate spring (elastic member)
14 support portion
15*a*, 15*b* opening portion
16 roll (first rotating member)
17 roll (second rotating member)
18 sensor (detecting unit)
19 helical spring (elastic member)

DESCRIPTION OF EMBODIMENTS

Hereinafter, an embodiment of the present invention will be described.

An electronic machine according to an embodiment of the present invention includes a speaker unit, a housing, and a rotating device. The speaker unit is supported by the housing and the rotating device includes a first rotating device that rotates the speaker unit with respect to the housing about a direction intersecting with an axis of the housing as a rotational axis and a second rotating device that rotates the speaker unit with respect to the housing about the axis of the housing as a rotational axis. Due to such an electronic machine, it is possible to arbitrarily change a direction of the speaker unit.

Also, the housing includes a first housing and a second housing, and the speaker unit is supported by the second housing through the first housing. The first rotating device may rotate the speaker unit with respect to the first housing and the second rotating device may rotate the speaker unit and the first housing with respect to the second housing.

Also, the first housing includes a shape to accommodate the speaker unit and the second housing includes a shape to accommodate the first housing. The first rotating device and the second rotating device may be attached to the first housing.

Further, the second rotating device may include a driving device (motor to be described below), a rotating member to which rotation of the driving device is transferred, and a rotated member. The rotated member may be arranged in the second housing. Since the electronic machine includes the rotated member, it is possible to transfer torque of the second rotating device to the second housing.

Also, the rotated member may be arranged in a central portion of the second housing. Since the torque of the second rotating device is relatively small, it is possible to reduce power consumption based on the second rotating device and, at the same time, to suppress enlargement based on the second rotating device.

An elastic member is attached to one of the first housing and the second housing, and the first housing may contact with the second housing through the elastic member. When the first housing is rotated by the second rotating device, there is a case in which a gap is formed between the second housing and the first housing. In such a case, the first housing and the second housing may contact with each other, causing an occurrence of noise. Further, vibration occurring in the case of rotating the speaker unit or driving the speaker unit may be propagated to the entire electronic machine. Hence, the first housing and the second housing contact with each other, causing an occurrence of noise. However, the first housing is brought into contact with the second housing through the elastic member, applying (urging) an elastic force from one of the first housing and the second housing to the other, thereby suppressing an occurrence of noise (rattling).

A side face of the speaker unit facing the first housing includes a contact portion which is in contact with the first housing and the first housing includes a contacted portion (concave portion to be described below). The speaker unit may move along the contacted portion of the first housing.

Also, one of the contact portion and the contacted portion is a convex portion and the other is a concave portion. The contact portion and the contacted portion may extend in a direction in which the first rotating device is rotated.

Also, the speaker unit includes a side face facing the first housing, and the contact portion may be arranged on a side face of the speaker unit in the first housing or may be arranged between a central portion and an outer peripheral portion in the side face of the speaker unit.

The contacted portion becomes a path upon rotation of the speaker unit. Since the contact portion slides along the contacted portion while coming into contact with the contacted portion, the speaker unit can be rotated along a predetermined path.

Also, the contact portion and the contacted portion extend in a direction in which the first rotating device is rotated, thereby reducing a thickness in an axis direction of the first housing or miniaturizing the electronic machine. Therefore, in a case where the electronic machine of the present invention is mounted in a front of a vehicle or a ceiling of a house, it is possible to make a space for the electronic machine small and to secure a space for arrangement of other electronic machines.

The contact portion of the speaker unit includes an opening portion. A member (rod-shaped member to be described below) fixed to the first housing may pass through the opening portion of the contact portion.

Also, a plurality of contact portions of the speaker unit may be provided, and the member fixed to the first housing may be a rod-shaped member. Since the member fixed to the first housing passes through the opening portion of the contact portion, there is no need to install a separate shaft. Therefore, it is possible to set a desired shaft as a rotational axis of the speaker unit, to miniaturize the electronic machine, to assembly the first housing and the second housing separately, or to remove and replace the speaker unit upon malfunction of the speaker unit.

A plurality of contact portions may be arranged in a side face of the speaker unit facing the first housing, a plurality of contacted portions may be arranged in the first housing, and the member fixed to the first housing may pass through the opening portions of the plurality of contact portions.

When the speaker unit is rotated by the first rotating device, a gap is generated between a rotating member of the first rotating device and a rotated member which the speaker unit has, thereby preventing torque of the driving device from being sufficiently transferred to the rotated member. Specifically, when the rotating member is a gear and the rotated member has a plurality of teeth corresponding to the gear, it is possible to prevent an occurrence of tooth jumping.

The member fixed to the first housing may be arranged in the vicinity of an end portion of an outer peripheral portion side of the speaker unit, from among two end portions of the opening portion of the contact portion.

Since member fixed to the first housing is arranged in the vicinity of an end portion of an outer peripheral portion side of the speaker unit, from among two end portions of the opening portion of the contact portion, it is possible to miniaturize the electronic machine, compared with the case of arranging the member fixed to the first housing in the vicinity of a central portion of the speaker unit. Also, in the case of rotating the speaker unit, it is possible to change a position of the member fixed to the first housing with respect to the opening portion between one end portion and the other end portion of the opening portion of the contact portion. That is, it is possible to set a range from the one end portion to the other end portion of the opening portion of the contact portion, as a range in which a position of the member fixed to the first housing can be changed within the opening portion. Therefore, it is possible to rotate the speaker unit in a wide range.

Also, it is possible to relatively reduce a length of the opening portion or a length of the contact portion.

The speaker unit may be supported by the first housing through the first rotating member, the first rotating member may be supported by a support portion of the first housing, and a rotational axis of the first rotating member may intersect with an axis of the first housing. When the speaker unit is rotated by the first rotating device while coming into contact with the first rotating member, a load on the first rotating device is relatively small and the speaker unit is smoothly rotated.

The second rotating member may be supported to the first housing, and the speaker unit may be supported to the first housing through the second rotating member.

Since the speaker unit is supported to the first housing through the second rotating member while coming into contact with the second rotating member, a load on the second rotating device is relatively small and the speaker unit is smoothly rotated when the speaker unit is rotated by the second rotating device.

A rotational axis of the speaker unit by the first rotating device may intersect with an axis of the speaker unit.

There may be provided a detecting unit configured to detect a position of the speaker unit. Also, the detecting unit may include a sensor. Also, the first housing may include a second contact portion that contacts with a side face of the speaker unit facing the first housing.

When the speaker unit is rotated by the first rotating device, the side face (rear face to be described below) of the speaker unit facing the first housing is in contact with the second contact portion, and therefore, a position of the second contact portion is changed. The sensor detects a change in the position to grasp a position of the speaker unit.

The speaker unit may be detachable from the first housing. When the speaker unit is detachable, the speaker unit is easily removed and replaced in a case where the speaker unit malfunctions.

The second housing may include a flap portion, and the flap portion may be arranged at a position facing the first housing. By providing the flap portion, it is possible to prevent dust, garbage or the like from entering into a space between the speaker unit and the first housing or a space between the first housing and the second housing. It is also possible to prevent an external force from acting on the front face of the speaker unit, and to prevent dust, garbage or the like from entering into the speaker unit. Also, it is possible to prevent sound wave radiated from the front face side of the speaker unit 2 from interfering with sound wave leaking from the rear face. Note that the "flap portion" is a portion of the "second housing" and is arranged in the "second housing". Various members arranged in the "second housing" are also arranged in the "flap portion".

The flap portion may have a face inclined from an outer peripheral portion of the second housing to a bottom portion of the speaker unit. Since the flap portion has the inclined face, sound wave emitted from the speaker unit is prevented from being blocked by the flap portion when the speaker unit is rotated by the first rotating device.

The speaker unit and the first housing may be connected to each other through an elastic member. Also, the elastic member may be formed of an extensible member. When the speaker unit is rotated by the first rotating device, a gap is generated between a rotating member of the first rotating device and a rotated member that the speaker unit has, thereby allowing torque of the driving device to be sufficiently transferred to the rotated member. Specifically, when the rotating member is a gear and the rotated member has a plurality of teeth corresponding to the gear, it is possible to prevent an occurrence of tooth jumping.

The electronic machine may include a control unit configured to control rotation of the speaker unit and an operation unit configured to transmit a signal of rotation of the speaker unit to the control unit. Also, the control unit may control rotation of the speaker unit by the first rotating device and the second rotating device such that the speaker unit is directed in a desired or set direction. Further, the operation unit may transmit a signal of a direction in which the speaker unit is to be directed based on information, such as a signal input from the outside. Therefore, a person listening to sound emitted from the speaker unit of the electronic device can direct the speaker unit in a desired direction by inputting information about the direction in which the speaker unit is to be directed to the operation unit.

Also, the control unit may receive a signal indicating that the electronic machine is in an off state and perform control such that the first rotating device and the second rotating device rotate the speaker unit to a normal position, and/or may receive a signal indicating that the electronic machine is in an on state and perform control such that the first rotating device and the second rotating device rotate the speaker unit in a desired or set direction. Since the electronic machine has the above configuration, the speaker unit is directed in a desired or set direction and is automatically in a standby state when the electronic machine is turned on. When the electronic machine is turned off, control is performed such that the speaker unit automatically returns to a normal position.

The electronic machine of the present embodiment may be provided and used in an automobile or in a house (accommodation unit). In this case, it is possible to arbitrarily focus a direction of the speaker unit on a person listening to sound from a speaker of the present electronic machine inside the automobile or the house. Also, it is possible to reduce power consumption in the case of changing a direction of the speaker unit. Also, it is possible to reduce an installation space of the present electronic machine.

EXAMPLES

An embodiment which is an exemplary embodiment of the present invention will be described with reference to FIGS. 1 to 20.

Figure 2:
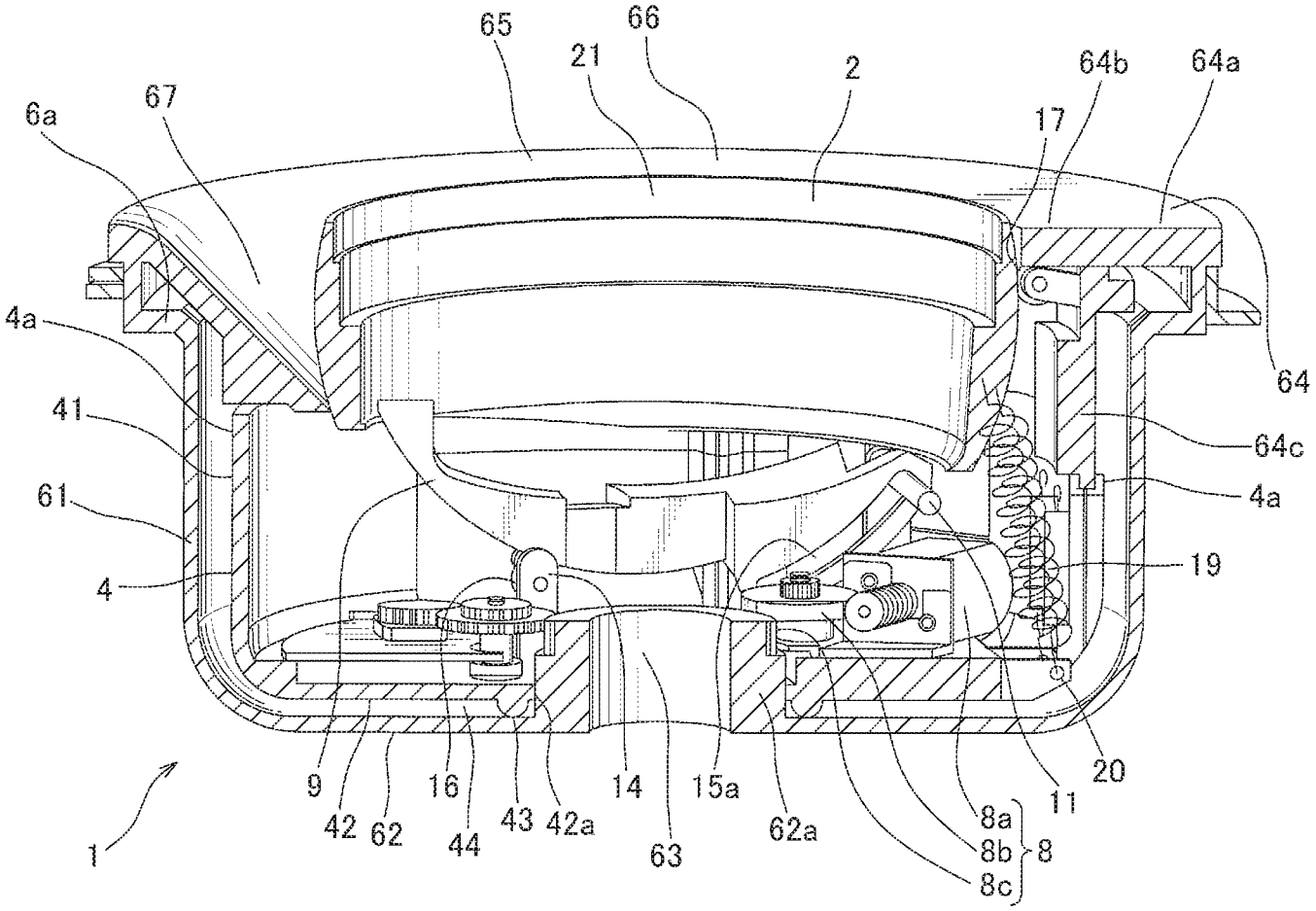
FIG. 2 is a cross-sectional view taken along A-A of FIG. 1.
Figure 3:
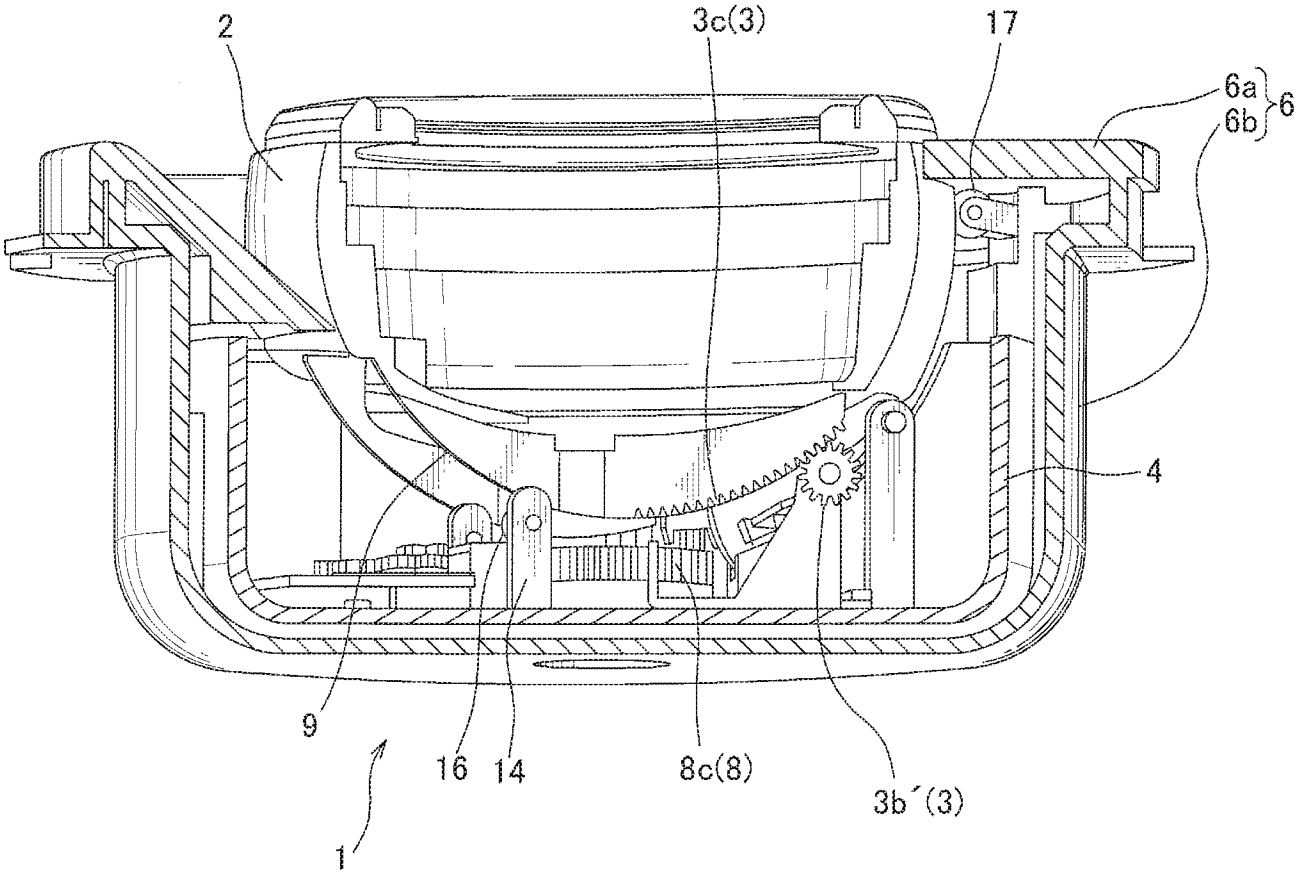
FIG. 3 is a cross-sectional view taken along B-B of FIG. 1.

FIG. 1 illustrates a perspective view of a speaker device (electronic machine) 1 of the present embodiment. Also, FIG. 2 is a cross-sectional view taken along A-A of FIG. 1, and FIG. 3 is a cross-sectional view taken along B-B of FIG. 1. As illustrated in FIGS. 1 to 3, the speaker device of the present embodiment mainly includes a speaker unit 2, a first housing 4, and a second housing 6. Also, in FIGS. 2 to 20, other things than the cabinet of a speaker unit to be described below are not illustrated.

The speaker unit 2 includes a cabinet 21, a frame, a diaphragm, an edge, a voice coil, a voice coil support portion supporting the voice coil, and a magnetic circuit (not illustrated). The cabinet includes an outer peripheral tubular portion and a bottom portion. The outer peripheral tubular portion and the bottom portion of the cabinet may include an opening portion or may have a closed shape that does not include the opening portion. The frame is disposed inside the cabinet. The diaphragm is supported to the frame through the edge. The voice coil is supported to the diaphragm through the voice coil support portion. The magnetic circuit includes a magnet, a yoke, and a plate, and there is a magnetic gap in which the voice coil is disposed. Also, if required, the voice coil may be supported to the frame through a damper. An acoustic radiation side (hereinafter referred to as a front face) of the speaker unit 2 is opened. That is, in the front face, a face of the cabinet has an opening portion. Sound wave emitted by the speaker unit 2 is radiated to the outside by passing through the opening portion of the cabinet. Hereinafter, the opposite side of the acoustic radiation side is referred to as a rear face side.

The first housing 4 is a housing to accommodate the speaker unit 2. The first housing 4 includes an outer peripheral tubular portion 41 and a bottom portion 42. Also, a projection portion 43 that projects toward the second housing 6 which is described below is provided. The projection portion 43 is formed in an annular shape.

The second housing 6 is a housing to accommodate the first housing 4. The second housing 6 includes an outer peripheral tubular portion 61 and a bottom portion 62. The bottom portion 62 includes an opening portion 63. The bottom portion 62 may not include the opening portion 63. The first housing 4 and the second housing 6 are arranged to be substantially disposed coaxially with each other.

A spacing 44 is provided between the bottom portion 42 of the first housing 4 and the bottom portion 62 of the second housing 6. Since the spacing is provided, a contact face between the first housing 4 and the second housing 6 is relatively small. Therefore, a frictional force occurring between the first housing 4 and the second housing 6 is relatively small and, in the second rotating device which is described below, the first housing 4 can be smoothly rotated with respect to the second housing 6.

The second housing 6 includes a flap portion 64 having an outer peripheral portion 64*a* and an inner peripheral portion 64*b*. The flap portion 64 is provided in the outer peripheral tubular portion 61 of the second housing 6. The outer peripheral tubular portion 61 and the flap portion 64 may be formed integrally or formed as separate members. The flap portion 64 is arranged at a position facing the first housing 4. Also, there is provided a face 65 covering a portion of the first housing. Since the face 65 is provided, dust or the like is prevented from entering into a space formed between the speaker unit 2 and the first housing 4 or a space formed between the first housing 4 and the second housing 6.

The face 65 of the flap portion 64 includes a first face 66 formed in a flat plate shape and an inclined face (second face) 67 inclined from the outer peripheral portion 6*a* of the second housing 6 toward the bottom portion of the speaker unit 2. Since the inclined face is provided, in a case where the speaker unit 2 is rotated in the first rotating device described below, the front face of the speaker unit 2 is shielded by the flap portion 64, thereby preventing a part of sound wave from not being radiated to the outside.

The first face of the flap portion 64 is provided at substantially the same position as the front face of the speaker unit 2. If required, the first face of the flap portion 64 may be provided at a position lower than or a position higher than the front face of the speaker unit 2.

The outer peripheral portion 4*a* of the first housing is disposed below the face of the flap portion 64.

The flap portion 64 is formed in an annular shape. The inner peripheral portion 64*b* of the flap portion 64 is formed to be substantially identical to or to be larger than the outer peripheral portion of the speaker unit 2. Since the inner peripheral portion 64*b* as described above is provided, the flap portion 64 and the outer peripheral portion of the speaker unit 2 are prevented from coming into contact with each other.

Figure 4:
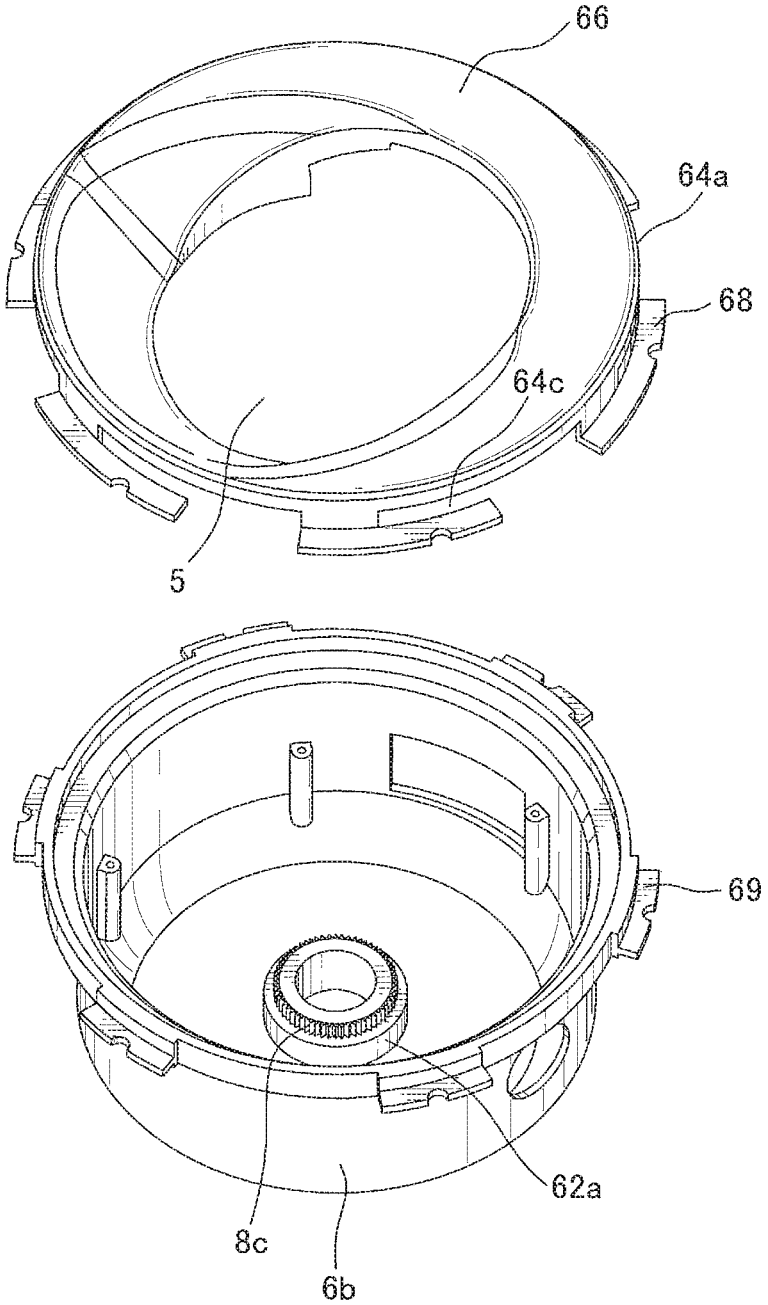
FIG. 4 is an exploded perspective view in which a housing is disassembled into a case portion and a flap portion.

FIG. 4 illustrates an exploded perspective view in which the second housing 6 is disassembled into the outer peripheral tubular portion 61 and the flap portion 64. As illustrated in FIG. 4, the flap portion 64 includes an opening portion 5. Since the flap portion 64 is provided, it is possible to prevent an external force from acting on the speaker unit 2, or to prevent dust or the like from entering into a space between the speaker unit 2 and the first housing 4. Also, it is possible to prevent sound wave radiated from the rear face side of the speaker unit 2 from interfering with sound wave radiated from the front face side of the speaker unit 2.

A speaker device 1 is manufactured as an electronic machine by incorporating the first housing 4, other components described below, and the speaker unit 2 inside the second housing 6 and then covering a portion of the opening portion of the second housing 6 with the flap portion 64. In this case, the flap portion 64 is mounted in the outer peripheral tubular portion 61 such that claws 68 of the flap portion 64 are disposed between claws 69 of the outer peripheral tubular portion 61 of the second housing 6, and the flap portion 64 is rotated with respect to the second housing 6 to arrange the claws 69 in gaps 64*c* between the face 66 of the flap portion 64 and the claws 68. Due to the above arrangement, attachment is made to the flap portion 64 and the outer peripheral tubular portion 61 of the second housing. Also, when the flap portion 64 is removed from the outer peripheral tubular portion 61 of the second housing, it is possible to remove the flap portion 64 by reversely rotating the flap portion 64 with respect to the outer peripheral tubular portion 61 and in case of repairment, it is possible to disassemble the flap portion 64.

Figure 5:
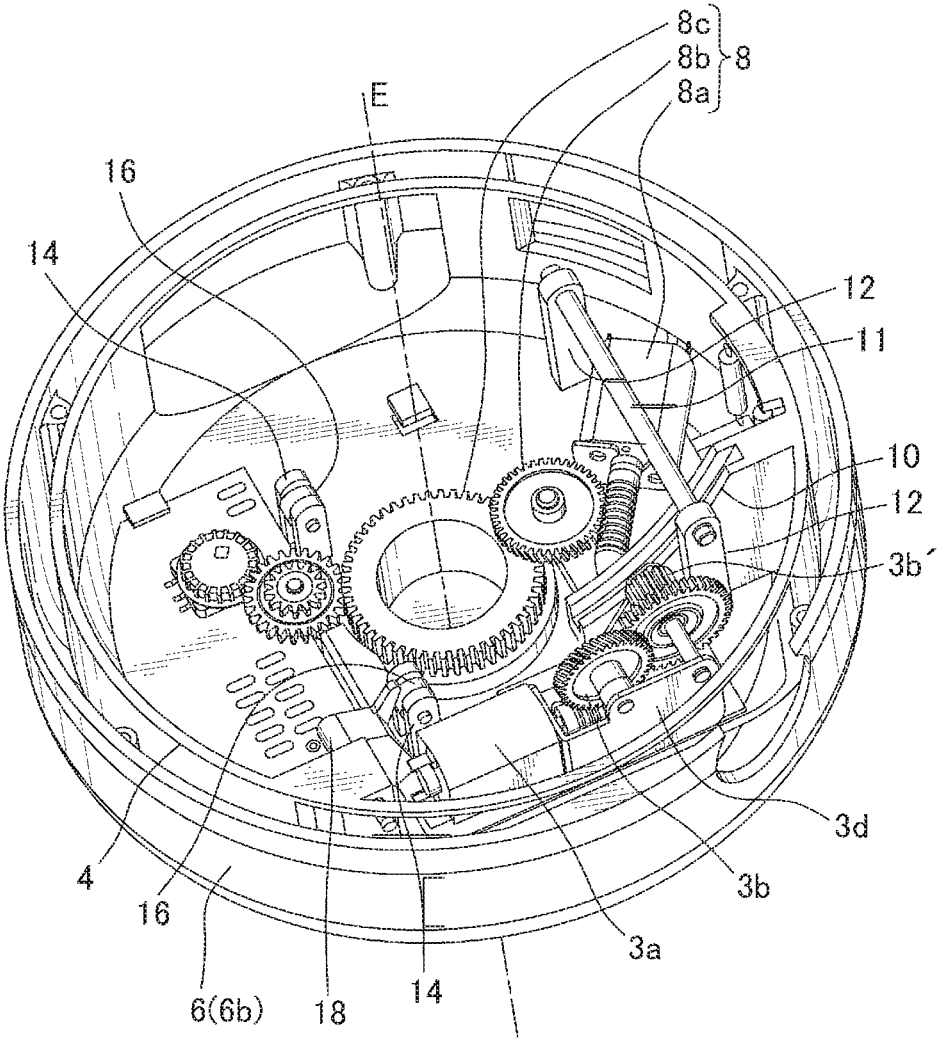
FIG. 5 is a perspective view of a state in which the flap portion and a speaker unit are removed from the electronic machine of FIG. 1.

FIG. 5 is a perspective view in a state where the flap portion 64 and the speaker unit 2 of the speaker device 1 of FIG. 1 are removed.

As illustrated in FIGS. 2 and 5, a second rotating device 8 is disposed in the vicinity of a central portion of the first housing 4. The second rotating device 8 includes a motor 8*a* as a driving device, a gear (rotating member) 8*b* to which rotation of the motor 8*a* rotatably supported to the first housing 4 is transferred, and a gear (rotated member) 8*c* to which rotation of the gear 8*b* fixed to the second housing 6 is transferred.

The gear 8*c* is provided in the projection portion 62*a* which the bottom portion 62 of the second housing 6 has.

The driving device is not particularly limited as long as the driving device provides torque to the rotating member. Any member can be used as the rotating member and the rotated member as long as the member can transfer torque. Examples of the member include a gear having teeth or a wheel having a face generating a frictional force. The gear 8*c* is arranged in the vicinity of the central portion of the second housing 6. Also, the gear 8*c* is arranged on an axis of the second housing 6. The gear 8*c* may be preferably fixed to the second housing 6, and the gear 8*c* may be formed integrally with or separately from the bottom portion 42 of the first housing 4.

The projection portion 62*a* is arranged inside the inner peripheral portion 42*a* which the bottom portion 42 of the first housing 4 has. Also, the first housing 4 is rotatably supported by the projection portion 43 of the first housing 4 with respect to the second housing 6.

When the motor 8*a* is driven, the torque of the motor 8*a* is transferred to the gear 8*b* engaging with the motor 8*a* and rotatably supported to the first housing 4, and the gear 8*b* is rotated with respect to the gear 8*c*.

In this way, the gear 8*c* and the gear 8*b* which have been stationary are in a rotating state, and the first housing 4 rotatably supported to the second housing 6 is rotated with respect to the second housing 6. Therefore, the first housing 4 and eventually, the speaker unit 2 accommodated in the first housing 4 are rotated in a plane, that is, in a direction of an arrow X-Y illustrated in FIG. 1 about an axis of the first housing 4 and the second housing 6 serving as a rotational axis (a dot dashed line E in FIG. 5).

In this way, since the second rotating device 8 is arranged inside the first housing 4 and also rotates the first housing 4 with respect to the second housing 6 about the axis of the first housing 4 and the second housing 6 serving as a rotational axis, the torque of the second rotating device 8 can be relatively small. Therefore, it is possible to reduce power consumption based on the second rotating device 8 and to suppress enlargement in the electronic machine based on the second rotating device 8.

Figure 6:
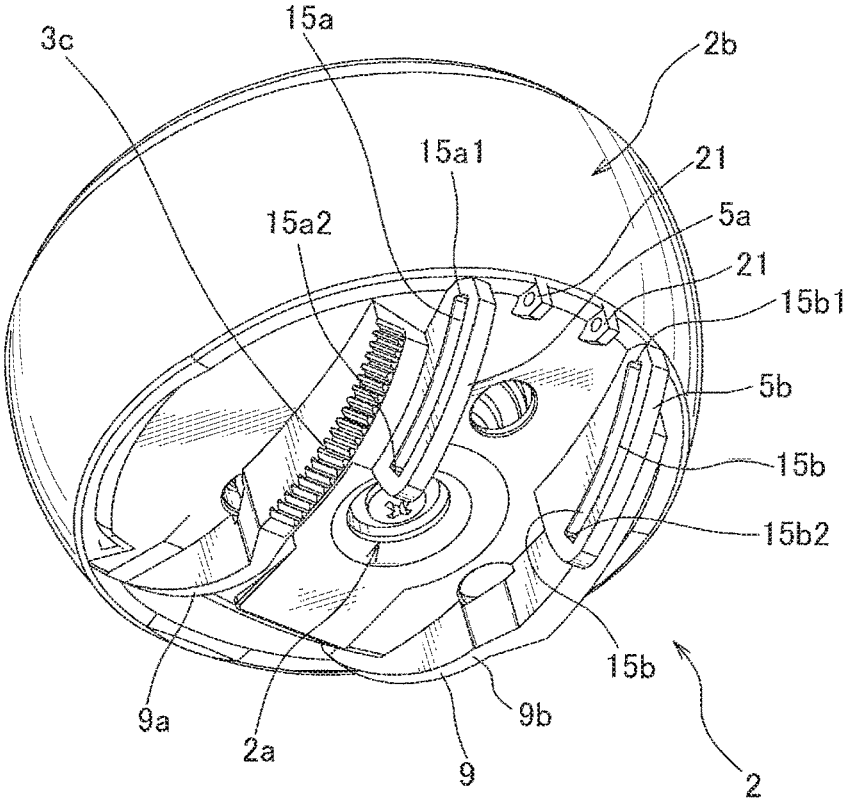
FIG. 6 is a perspective view viewed from a rear face side of the speaker unit.

As described above, the speaker unit 2 is accommodated in the first housing 4. FIG. 6 illustrates a perspective view seen from the rear face side of the speaker unit 2. In the rear face of the speaker unit 2, first contact portions 5*a* and 5*b*, a gear (rotated member) 3*c*, and second contacted portions 9*a* and 9*b* corresponding to the contact portion 18 described below are provided.

The first contact portions 5*a* and 5*b* are arranged in parallel to a side face of the rear face side of the speaker unit 2. The first contact portions 5*a* and 5*b* are substantially arranged in parallel to each other. Also, the first contact portions 5*a* and 5*b* are arranged between the central portion 2*a* and the outer peripheral portion 2*b* in a side face of the rear face side of the speaker unit 2 and extend from the central portion 2*a* toward the outer peripheral portion 2*b*. Since the first contact portions 5*a* and 5*b* are arranged between the central portion 2*a* and the outer peripheral portion 2*b*, it is possible to reduce a thickness in an axis direction of the first housing 4 and eventually to miniaturize the speaker device 1, compared to the case of arranging the first contact portions 5*a* and 5*b* in the central portion 2*a*. Therefore, in a case where the speaker device 1 of the present embodiment is mounted in a front of a vehicle or a ceiling of a house, it is possible to make a space for the speaker device 1 small and to secure a space for arrangement of other electronic machines.

On the other hand, as illustrated in FIG. 5 or the like, a first contacted portion 10 into which one 5*a* of the first contact portion 5*a* and 5*b* is slidably fitted is provided inside the first housing 4. The first contacted portion 10 has a shape corresponding to the first contact portion 5*a* or 5*b*, and is formed in a concave shape. The first contact portions 5*a* and 5*b* extend in a circular arc shape as an axis about which the speaker unit 2 is rotated with respect to the first housing 4.

Shapes of the first contact portions 5*a* and 5*b* are not particularly limited as long as they form a path through which the speaker unit described below is rotated. For example, one of the first contact portions 5*a* and 5*b*, for example, the first contacted portion 10 has a convex shape and the other has a concave shape. Also, a plurality of first contacted portions 10 may be provided in the first housing 4, corresponding to a plurality of contact portions.

Figure 7:
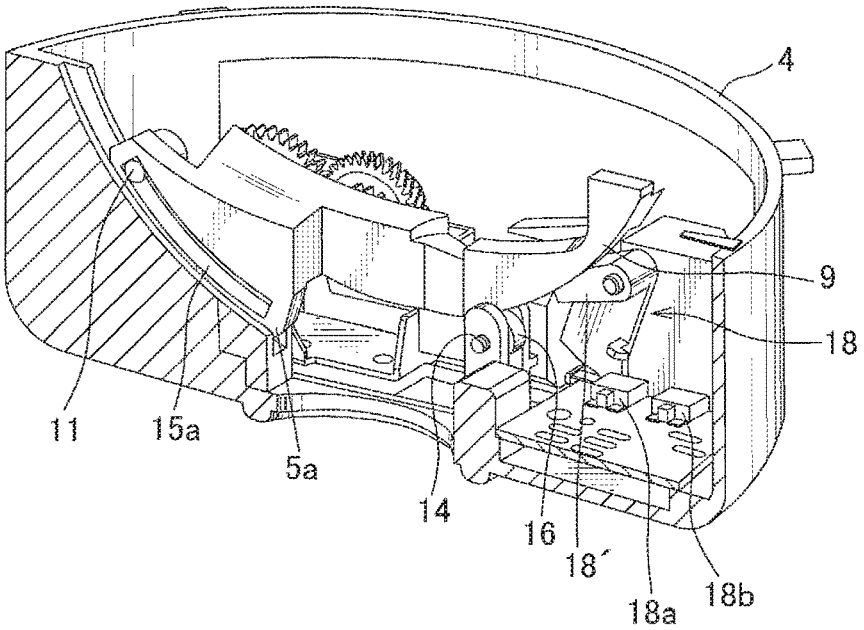
FIG. 7 is a cross-sectional perspective view viewed from a cross-sectional face when a first housing 4 is cut laterally in a rear side of a concave portion in FIG. 5.

FIG. 7 is a perspective view in a case where the first housing 4 is cut out at a position behind the central portion thereof. For explanation, a portion of the speaker unit 2 is illustrated. As illustrated in FIG. 7, the first contact portion 5*a* is fitted into the first contacted portion 10 and slides along the first contacted portion 10 serving as a path. Since the first contact portion 5*a* slides along the first contacted portion 10 serving as the path, the speaker unit 2 can be rotated along a predetermined path.

The first contact portions 5*a* and 5*b* includes opening portions 15*a* and 15*b*. The opening portions 15*a* and 15*b* open side faces of the first contact portions 5*a* and 5*b* and are formed along a direction in which the first contact portions 5*a* and 5*b* extend. On the other hand, a rod-shaped member 11 is arranged in the first housing 4 as a member fixed to the first housing 4. The rod-shaped member 11 is fixed to the first housing 4 through a support portion 12. The rod-shaped member 11 passes through the opening portions 15*a* and 15*b* of the first contact portions 5*a* and 5*b*.

Since the rod-shaped member 11 passes through the opening portions 15*a* and 15*b*, the first contact portion 5*a* can be maintained in a state of engaging with the first contacted portion 10 and rotation of the speaker unit 2 is smoothly made.

Also, in the case of rotating the speaker unit 2, it is possible to restrain use of a shaft which becomes a rotational axis thereof. Therefore, it is possible to set the rotational axis at a desired position. Also, it is possible to exclude a space in which the shaft is to be arranged by restraining use of the shaft as the rotational axis, it is possible to miniaturize the speaker device 1 itself. Also, by restraining the use of the shaft, it is possible to assemble the speaker unit 2, the first housing 4 and the second housing 6 individually. When the speaker unit 2 malfunctions, it is possible to remove and replace the speaker unit 2.

A first rotating device 3 that rotates the speaker unit 2 about a direction intersecting with an axis of the first housing 4 serving as a rotational axis (a dashed line C in FIG. 1) is disposed inside the first housing 4. Also, the rotational axis also intersects with an axis of the speaker unit 2. In the illustrated example, the rotational axis indicated by a dashed line C in FIG. 1 is a direction substantially intersecting with the first housing 4. Also, the rotational axis indicated by a dashed line C in FIG. 1 is substantially intersecting with an axis of the speaker unit 2.

The first rotating device 3 includes a motor 3*a* that is a driving device, a gear (rotating member) 3*b* to which rotation of the motor 3*a* is transferred, a gear (rotating member)

3*b*' to which rotation of the gear 3*b* is transferred, a gear 3*c* (rotated member) 3*c* to which rotation of the gear 3*b*' is transferred and which is provided in a rear face of the speaker unit 2, and a support portion 3*d*. The gear 3*b* and the gear 3*b*' are rotatably supported to the first housing 4 by the support portion 3*d*. The driving device is not particularly limited as long as the driving device can provide torque to the rotating member. Any member can be used as the rotating member and the rotated member as long as the member can transfer torque. Examples of the member include a gear having teeth or a wheel having a face generating a frictional force. The first rotating device 3 is arranged adjacent to the second rotating device 8 between the central portion and the outer peripheral tubular portion 42 of the first housing 4.

When the motor 3*a* is driven, the rotation thereof is transferred to the gear 3*b* engaging with the motor 3*a* and then to the gear 3*b*', thereby resulting in cascaded rotation of the gears. The rotation thereof is transferred to the gear 3*c* engaging with the gear 3*b*' and fixed to the side face of the rear face side of the speaker unit 2 and the speaker unit 2 is rotated with respect to the first housing 4 along with the gear 3*c*.

Therefore, the speaker unit 2 accommodated in the first housing 4 is rotated about a direction intersecting with the axis of the first housing 4 serving as a rotational axis (a dashed line C-C in FIG. 1). As illustrated in FIG. 1, a direction of the rotation is a direction of an arrow Z, that is, a direction of an arrow Z' in FIG. 1 in which an edge portion of the speaker unit 2 is rotated. As described above, since the speaker unit 2 can be moved in the direction of the arrow Z' in FIG. 1 and in the X-Y direction in FIG. 1 in the present embodiment, it is possible to arbitrarily change a direction of a speaker.

When the speaker unit 2 is rotated by the first rotating device 3, it is likely that engagement (connection between rotating members which the second rotating device 3 has) between the motor 3*a* and the gear 3*b* to which rotation of the motor 3*a* is transferred, between the gear 3*b* and the gear 3*b*', and between the gear 3*b*' and the gear 3*c* (hereinafter, referred to "among the motor 3*a* and the gears 3*b*, 3*b*', and 3*c*") will be released in the first rotating device 3, causing tooth jumping between the motor 3*a* and the gears 3*b*, 3*b*' and 3*c* (torque is not accurately transferred).

However, when the rod-shaped member 11 extending substantially in parallel to the rotational axis (a dashed line C) of the speaker unit 2 which is disposed inside the first housing 4 passes through two (or more) of the opening portions 15*a* and 15*b* of the first contact portions 5*a* and 5*b*, the engagement among the gears 3*b*, 3*b*' and 3*c* of the first rotating device 8 (connection between rotating members which the first rotating device 8 has) is prevented from being released, thereby preventing torque from not being transferred, such as tooth jumping. Also, the motor 3*a* and the gears 3*b* and 3*b*' are supported by the support portion 3*d* provided in the first housing 4. By using the support portion 3*d*, it is possible to prevent release of the engagement among the motor 3*a* and the gears 3*b* and 3*b*' (connection between the rotating members which the first rotating device 8 has).

The opening portions 15*a* and 15*b* of the first contact portions 5*a* and 5*b* have two end portions respectively. In the illustrated example, one end portion 15*a*1 or 15*b*1 of two end portions is arranged in an outer peripheral portion side of the speaker unit 2 and the other end portions 15*a*2 or 15*b*2 is arranged in a central portion side of the speaker unit 2.

When the speaker unit 2 is arranged at a normal position, the rod-shaped member 11 is arranged inside the opening portions 15*a* and 15*b* adjacent to the one end portions 15*a*1 and 15*b*1 of the opening portions 15*a* and 15*b*.

In this case, the normal position is a position of the speaker unit 2 before the first rotating device and the second rotating device are driven. Specifically, as illustrated in FIG. 2 or 7, the normal position is a position at which the front face of the speaker unit 2 is arranged in an opening portion side of the second housing, and the normal position may be arbitrarily changed.

By arranging the rod-shaped member 11 adjacent to the one end portions 15*a*1 and 15*b*1 of the opening portions 15*a* and 15*b*, it is possible to setting a length from the one end portions 15*a*1 and 15*b*1 of the opening portions 15*a* and 15*b* to the other end portions 15*a*2 or 15*b*2 to a movement width of the rod-shaped member 2 in a case of changing a direction of the speaker unit 2. Therefore, it is possible to change a direction of the speaker unit 2 in a wide range. Also, it is possible to make the length of the opening portion 15*a* (15*b*) or the first contact portion 5*a* (5*b*) relatively small, and at the same time, to make a rotatable range of the speaker unit 2 relatively large.

Figure 8A:
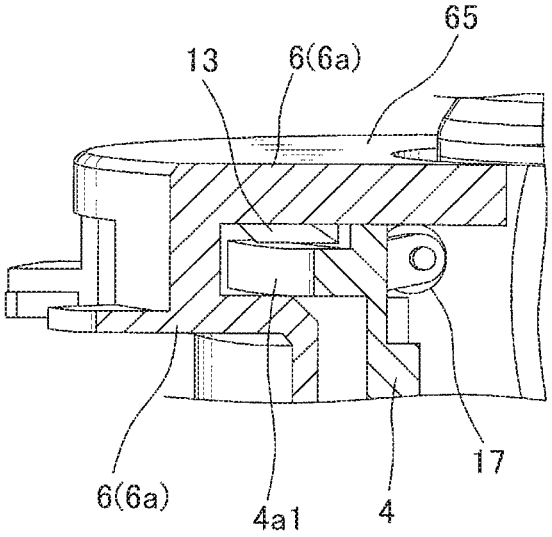
FIG. 8A is an enlarged view of a peripheral of an end portion (an arrow D indicates a peripheral portion in FIG. 1) of a front face side of the electronic machine of FIG. 1 and is a partial enlarged cross-sectional view.
Figure 8B:
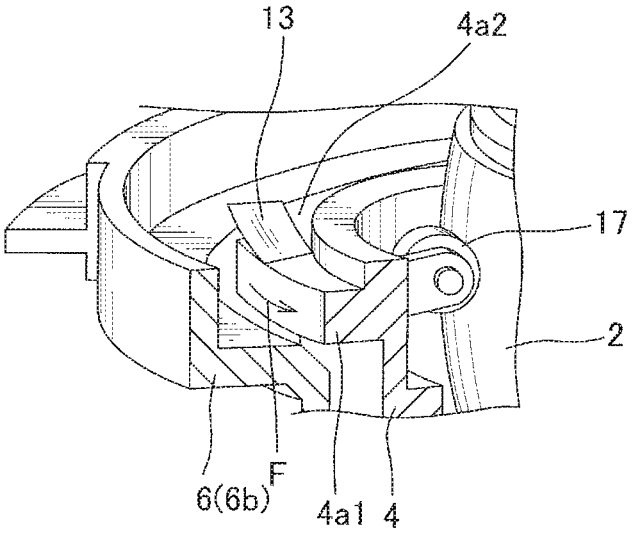
FIG. 8B is an enlarged views of a peripheral of an end portion (an arrow D indicates a peripheral portion in FIG. 1) of a front face side of the electronic machine of FIG. 1 and is a partial enlarged cross-sectional perspective view.
Figure 9:
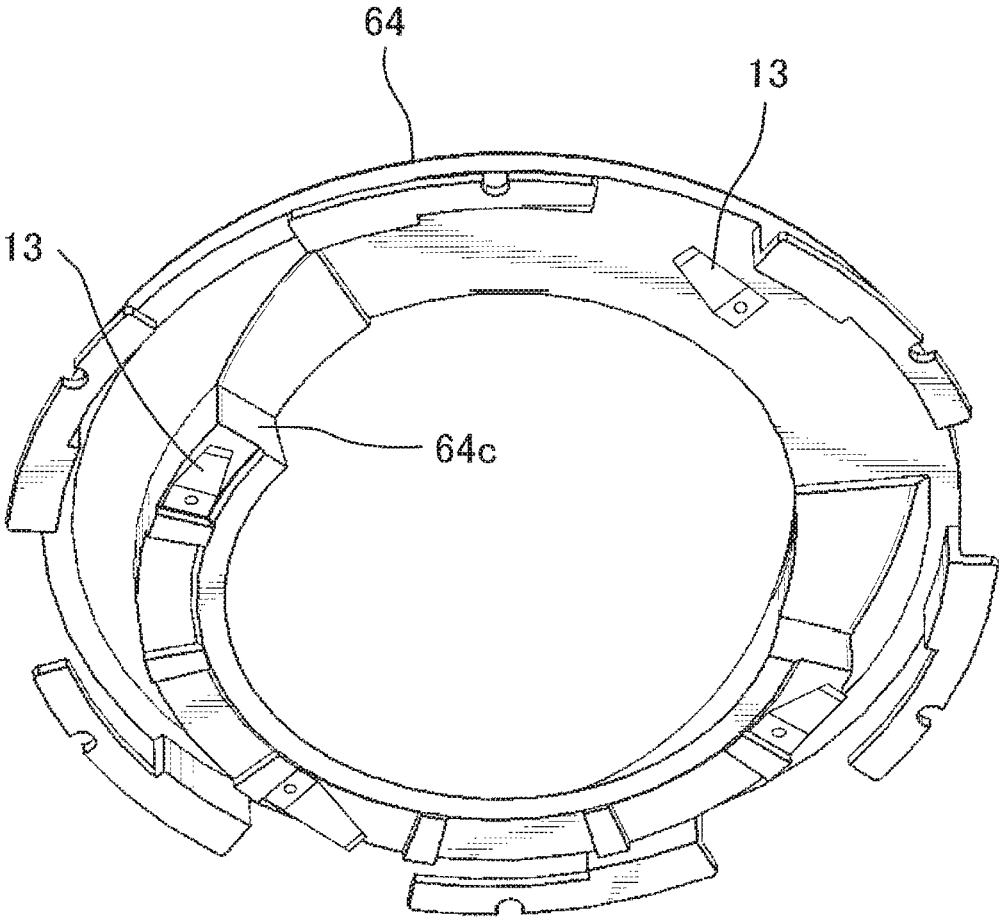
FIG. 9 is a perspective view illustrating a plurality of elastic members arranged in a face of a rear face side of a tubular portion.

FIGS. 8A and 8B are enlarged views of an outer peripheral portion (an arrow D indicates a peripheral portion in FIG. 1) of the speaker device 1 of the present embodiment. FIG. 8A is a view enlarging a cross-sectional view of a portion of the outer peripheral portion of the speaker device 1, and FIG. 8B is a perspective view enlarging the portion. In FIG. 8B, the flap portion 64 of the second housing 6 is omitted.

As illustrated in FIGS. 8A and 8B, in the outer peripheral portion of the speaker device 1, the outer peripheral portion 4*a* of the first housing 4 is arranged in the outside of the speaker unit 2 and the outer peripheral portion 6*a* of the second housing 6 is arranged in the outside of the first housing 4. A face 65 of the flap portion 64 of the second housing 6 protrudes to cover the outer peripheral portion 4*a* of the first housing 4.

Also, the outer peripheral portion 4*a* of the first housing 4 includes a protrusion 4*a*1 protruding to the second housing 6 side. The protrusion 4*a*1 is formed in an annular shape and also includes a face 4*a*2 facing the flap portion 64. One end portion of a plate spring (elastic member) 13 is attached to a bottom face of the flap portion 64 facing the protrusion 4*a*1 and the other end portion is in contact with a face 4*a*2 of the protrusion 4*a*1. The plate spring 13 is formed of a metal member, such as phosphor bronze, or a resin member, such as rubber or polyurethane resin. An elastic force (biasing force) of the plate spring acts on the first housing 4 in a direction from the flap portion 64 to the first housing 4. Also, an elastic force (biasing force) acts on the flap portion 64 in a direction from the first housing 4 to the second housing 6.

When the first housing 4 is rotated with respect to the second housing 6 by the second rotating device 8, with the axis of the first housing 4 and the second housing 6 serving as a rotational axis (a dot-dashed line E in FIG. 5), the first housing 4 is rotated in a direction of an arrow F in FIG. 8B, and the plate spring 13 moves over the face 4*a*2 of the protrusion 4*a*1. That is, the first housing 4 and the second housing 6 is in contact with each other through the elastic member 13 fixed to the second housing 6.

Also, the elastic member 13 is attached to a tubular portion 64*c* of the flap portion 64 illustrated in FIG. 1. It can be seen from FIG. 9 that a plurality of elastic members 13 are arranged in a face of the rear face side of the tubular portion 64*c*. The elastic member 13 is arranged at a different position in a circumferential direction. Also, the elastic member 13 is in contact with the outer peripheral portion 4*a* of the first housing 4.

When the first housing 4 is rotated by the second rotating device 8 in a case where a gap is formed between the second housing 6 and the first housing 4, the first housing 4 and the second housing 6 may come into contact with each other, thereby causing an occurrence of noise. Further, vibration occurring in the case of rotating the speaker unit 2 or driving the speaker unit 2 may be propagated to the entire speaker device 1. Hence, the first housing 4 and the second housing 6 come into contact with each other, causing an occurrence of noise.

However, by preparing the elastic member 13 between the first housing 4 and the second housing 6 as in the present embodiment, an elastic force (biasing force) is applied such that the second housing 6 is directed to the first housing 4, thereby suppressing an occurrence of noise (rattling).

Although the elastic member 13 is illustrated as moving with respect to the first housing 4 fixed to the second housing 6 in the present embodiment, the elastic member 13 may move with respect to the second housing 6 fixed to the first housing 4.

A support portion 14 fixed to the bottom portion 42 of the first housing 4 and a roll (first rotating member) 16 supported to the support portion 14 are provided inside the first housing 4. As illustrated in FIGS. 2, 3 and 7, the speaker unit 2 is rotated by the first rotating device 3 while a second contacted portion 9 provided in a side face of the rear face side of the speaker unit 2 comes into contact with the roll 16. That is, the speaker unit 2 is supported to the first housing 4 through the roll 16 and the support portion 14. Since the side face of the rear face side of the speaker unit 2 (specifically a second contacted portion 9) is supported to the first housing 4 through the roll 16 and the support portion 14 while being in contact with the roll 16 which is being rotated, the speaker unit 2 is smoothly rotated when a direction of the speaker unit 2 is changed by the first rotating device 3.

As illustrated in FIGS. 2, 3, 8A and 8B, a roll (second rotating member) 17 is provided in the outer peripheral portion 4*a* of the first housing 4. As seen from the drawings, the roll 17 is supported to the first housing in a state of being rotatable in a direction (direction of an arrow Z') in which the speaker unit 2 is rotated by the first rotating device 3. Also, the side face of the rear face side of the speaker unit 2 comes into contact with the roll 17, and is supported to the first housing 4 through the roll 17. Therefore, when a direction of the speaker unit 2 is changed by the first rotating device 3, the speaker unit 2 is smoothly rotated. In particular, by providing the roll 17 and the support portion 14, the speaker unit 2 is caused to be smoothly rotated.

As illustrated in FIGS. 8A and 8B, the roll 17 is disposed in the vicinity of the plate spring (elastic member) 13. When the speaker unit 2 is rotated by the first rotating device 3, the vibration thereof is propagated between the first housing 4 and the second housing 6 through the roll 17. Hence, the first housing 4 and the second housing 6 may come into contact with each other, causing an occurrence of noise. Since the plate spring 13 is arranged in the vicinity of the roll 17, the vibration is damped to suppress an occurrence of noise.

As illustrated in FIGS. 5 and 7, a detecting unit 18 is arranged inside the first housing 4. The detecting unit 18 includes a plurality of sensors 18*a* and 18*b*, and a contact portion 18' which comes into contact with the second contacted portion 9 provided in the rear face of the speaker unit 2. As the sensor, a known sensor, such as an optical sensor, a photoelectric element, or a photo diode, can be used. When the speaker unit 2 is rotated by the first rotating device 3, the sensors 18*a* and 18*b* detect that a position of the contact portion 18' which comes into contact with the side face (specifically, the second contacted portion 9) of the rear face side of the speaker unit 2 is changed. The sensor 18*a* detects that the speaker unit 2 is disposed, for example, at a normal position, and the sensor 18*b* detects that the speaker unit 2 is rotated to the maximum rotation angle by the second rotating device. In this way, by using the plurality of sensors 18*a* and 18*b*, two different positions of the contact portion 18' are grasped, and therefore, a position of the speaker unit 2 (rotation angle) can be grasped. Also, feedback control can be performed based on the detected information by a control function of an operation unit which is described below.

In the present embodiment, as illustrated in FIG. 2, the speaker unit 2 and the first housing 4 are connected to each other through an extensible helical spring (elastic member) 19. One end portion of the helical spring 19 is connected to a connection portion 20 provided in the bottom portion 42 of the first housing 4 and the other end portion is connected to a connection portion 21 (see FIG. 6) provided in the side face of the rear face side of the speaker unit 2. The speaker unit 2 and the first housing 4 are connected to each other through the helical spring 19.

When the speaker unit 2 is rotated by the first rotating device 3, there is a case where engagement among the motor 3*a*, and gears 3*b*, 3*b*' and 3*c* of the first rotating device 3 (connection between rotating members which the first rotating device 3 has) is released, causing an occurrence of tooth jumping of gears (torque is not accurately transferred). However, since the speaker unit 2 and the first housing 4 is connected through the helical spring 19, it is possible to prevent release of the engagement among the motor 3*a*, and gears 3*b*, 3*b*' and 3*c* of the second rotating device 3 (connection between the rotating members which the first rotating device 3 has), thereby preventing an occurrence of a state in which torque is not accurately transferred, such as tooth jumping.

Although the helical spring 19 is used in the present embodiment, any extensible elastic member may be used, and various types of existing known elastic members, such as a general rubber string or a rubber band, can be used.

In the present embodiment, the speaker unit 2 is configured to be detachable from the first housing 4. First, the flap portion 64 of the speaker unit 2 is removed. Second, the rod-shaped member 11 is pulled out from the opening portions 15*a* and 15*b*. Third, the helical spring 19 is hooked and removed from a hole 21. Thereafter, the first housing 4 and the speaker unit 2 which are accommodated in the second housing 6 can be separated from the second housing 6. Also, installation can be simply performed in the reverse sequence. Since the speaker unit 2 is detachable, the speaker unit 2 can be removed and replaced with a new speaker unit 2 when the speaker unit 2 malfunctions.

In the present embodiment, the speaker unit 2 may include a control unit (not illustrated) that performs control such that rotation of the speaker unit 2 by the first rotating device 3 and the second rotating device 8 is directed in a desired direction (including a request brought about by information from another control device, in addition to information from a operation unit to be described below), or a set direction (including a request brought about by information previously stored in a storage means or the like, or information remembered by a user in advance, in addition to information preset in the speaker device 1 itself) and an operation unit (not illustrated) that transmits a signal of a direction in which the speaker unit is to be directed, based on information input from the outside to the control unit.

Therefore, a person listening to sound from a speaker of the speaker device 1 of the present embodiment can direct the speaker unit in a desired direction by inputting information about a direction in which the speaker unit 2 is to be directed to the operation unit. The operation unit may be embedded in a body of the speaker device 1 and may have the type of a remote control that can exchange a signal by wireless or wired. Also, a computer or an on-vehicle device of an automobile (navigation system, car audio system, or the like) may perform the function of the operation unit.

Also, the control unit may receive a signal indicating that the speaker device 1 itself is turned off and controls the rotation of the speaker unit 2 by the first rotating device 3 and the second rotating device 8 such that the speaker unit 2 is located at the normal position at which the front face of the speaker unit 2 is directed frontward. In addition, the control unit may receive a signal indicating that the speaker device 1 itself is turned on and controls the rotation of the speaker unit 2 by the first rotating device 3 and the second rotating device 8 such that the speaker unit 2 is directed in a desired or set direction. According to the above configuration, control is performed such that, when the speaker device 1 itself is turned on, the speaker unit 2 is directed in a desired or set direction and automatically is in a so-called standby state, and when the speaker device 1 itself is turned off, the speaker unit 2 automatically returns to the normal position.

The speaker device 1 of the present embodiment is useful when an automobile or a house is equipped with the speaker device 1.

When the automobile is equipped with the speaker device 1 of the present embodiment, the speaker device 1 may be installed in, for example, an inner door, a dashboard, a rear tray, a luggage tray, a ceiling, various types of pillars or the like. In this case, a person listening to sound within the automobile can perform an input through the operation unit in consideration of the number of riding persons, riding positions, or tastes or states of respective persons and can control a direction of the speaker unit 2 in an optimal state or an intended state. It may be configured to grasp the number of riding persons or the riding positions by using a detecting means of the automobile, to calculate an optimal speaker direction based on the information by using the control unit or the like, and to automatically change the direction of the speaker unit 2.

Also, the speaker device 1 of the present embodiment reduces power consumption in the case of changing a direction of the speaker unit 2, thereby making a load on an on-vehicle battery small. Furthermore, since the speaker device 1 of the present embodiment reduces an installation space, it is possible to secure a space for arranging another electronic machine, an engine component, other on-vehicle devices and components or the like.

When a house is equipped with the speaker device 1 of the present embodiment, the speaker device 1 may be embedded in a house structure, such as, a wall, a ceiling, a floor, a beam, or a pillar or may be embedded in or attached to a house appurtenance, such as furniture. In this case, a person who listens to sound in a room of a house (accommodation unit) can perform an input through the operation unit in consideration of the number and positions of persons existing in the room, or tastes or states of respective persons, or the structure of the room, and control a direction of the speaker unit 2 in an optimal state or an intended state. It may be configured to grasp the number or positions of persons existing in the room by using a detecting means of the room, to calculate an optimal speaker direction based on the information by using the control unit or the like, and to automatically change the direction of the speaker unit 2.

Also, the speaker device 1 of the present embodiment reduces power consumption in the case of changing a direction of the speaker unit 2, thereby archiving energy saving. Furthermore, since the speaker device 1 of the present embodiment reduces an installation space, it is possible to secure a space for arranging another electronic machine, a house component, other house appurtenances and household goods or the like.

It should be noted that the above-described embodiments are typical exemplary ones of the present invention and therefore the present invention is not limited to these embodiments. The present invention can be effectuated with various modifications within the scope and the spirit of the present invention.

What is claimed is:

1. An electronic machine comprising:
a speaker unit;
a housing; and
a rotating device,
wherein the rotating device rotates the speaker unit with respect to the housing,
wherein the speaker unit is provided with a contact portion projecting with respect to a side face of the speaker unit and contacting the housing,
wherein the contact portion is provided with an opening portion,
wherein a member which is supported by the housing and extends substantially in parallel to a rotational axis of the speaker unit is adapted to passing through the opening portion, and
wherein the housing includes a contacted portion, and the contacted portion is in a concave shape and fitted with the contact portion.

2. The electronic machine according to claim 1,
wherein the speaker unit moves along the contacted portion of the housing.

3. The electronic machine according to claim 2,
wherein the contact portion and the contacted portion extend in a rotation direction of the rotating device.

4. The electronic machine according to claim 3,
wherein the opening portion is formed along a direction in which the contact portion extends.

5. The electronic machine according to claim 1,
wherein the rotating device includes a first rotating device that rotates the speaker unit; and a second rotating device that rotates the speaker unit with respect to the housing about the axis of the housing serving as a rotational axis.

6. The electronic machine according to claim 5,
wherein the housing includes a first housing and a second housing, and
wherein the speaker unit is supported by the second housing through the first housing, the first rotating device rotates the speaker unit with respect to the first housing, and the second rotating device rotates the speaker unit and the first housing with respect to the second housing.

7. The electronic machine according to claim 6,
wherein the first housing has a shape accommodating the speaker unit, the second housing has a shape accommodating the first housing, and the first rotating device and the second rotating device are attached to the first housing.

8. The electronic machine according to claim 7, wherein the second rotating device includes a driving device, a rotating member to which rotation of the driving device is transmitted, and a rotated member, and wherein the second housing includes the rotated member.

9. The electronic machine according to claim 8, wherein the rotated member is arranged in a central portion of the second housing.

10. The electronic machine according to claim 6, wherein an elastic member is attached to one of the first housing and the second housing, and the first housing contacts with the second housing through the elastic member.

11. The electronic machine according to claim 10, wherein the speaker unit is supported by the first housing through the first rotating member, the first rotating member is supported by a support portion of the first housing, and a rotational axis of the first rotating member intersects with an axis of the first housing.

12. The electronic machine according to claim 6, wherein the second housing includes a flap portion, and wherein the flap portion is arranged at a position opposite to the first housing.

13. The electronic machine according to claim 12, wherein the flap portion includes a face inclined from an outer peripheral, portion of the second housing to a bottom portion of the speaker unit.

14. The electronic machine according to claim 1, further comprising a plurality of opening portions, wherein the member is formed in a rod-shape.

15. The electronic machine according to claim 14, wherein the member is arranged in the vicinity of one end of an outer peripheral portion side of the speaker unit, of two ends of the opening portion.

16. The electronic machine according to claim 1 further comprising a detecting unit to detect a position of the speaker unit.

17. The electronic machine according to claim 16, wherein the detecting-unit is attached to the first housing, and a position of the speaker unit with respect to the first housing is detected by the detecting unit.

18. An automobile comprising the electronic machine according to claim 1.

19. An accommodation unit comprising the electronic machine according to claim 1.

* * * * *